US008397953B2

(12) United States Patent
Kaufman

(10) Patent No.: US 8,397,953 B2
(45) Date of Patent: Mar. 19, 2013

(54) PERSONAL PROTECTION DEVICE

(76) Inventor: Alan Kaufman, New York, NY (US)

( * ) Notice: Subject to any disclaimer, the term of this patent is extended or adjusted under 35 U.S.C. 154(b) by 436 days.

(21) Appl. No.: 12/657,033

(22) Filed: Jan. 12, 2010

(65) Prior Publication Data

US 2010/0237098 A1 Sep. 23, 2010

Related U.S. Application Data

(60) Provisional application No. 61/204,927, filed on Jan. 13, 2009.

(51) Int. Cl.
*B67D 1/07* (2006.01)
*B65D 5/66* (2006.01)
*F21V 33/00* (2006.01)

(52) U.S. Cl. ..... 222/192; 222/402.13; 222/113; 222/183

(58) Field of Classification Search ..... 222/113, 222/182, 183, 175, 153.11, 402.11, 192, 222/402.13, 402.23
See application file for complete search history.

(56) References Cited

U.S. PATENT DOCUMENTS 3,684,185 A * 8/1972 Milcos ..... 239/337
3,776,429 A * 12/1973 DeLucia ..... 222/162
4,186,851 A * 2/1980 Cantor ..... 222/113
4,301,946 A * 11/1981 Goldin et al. ..... 222/113
5,070,611 A * 12/1991 Derin et al. ..... 30/41
5,373,427 A * 12/1994 McLean ..... 362/96
5,420,766 A * 5/1995 Hollis ..... 362/96
5,676,311 A * 10/1997 Hartman ..... 239/120
6,056,160 A * 5/2000 Carlucci et al. ..... 222/146.3
6,321,952 B1 * 11/2001 Cassier et al. ..... 222/505
6,398,082 B2 * 6/2002 Clark et al. ..... 222/402.11
6,439,432 B1 * 8/2002 Park ..... 222/113
6,896,192 B2 * 5/2005 Horan et al. ..... 239/1
7,121,432 B2 * 10/2006 Kostal et al. ..... 222/192
2007/0194048 A1 * 8/2007 Teig ..... 222/113
2007/0241134 A1 * 10/2007 Gurrisi et al. ..... 222/153.11

* cited by examiner

*Primary Examiner* — Paul R Durand
*Assistant Examiner* — Charles P Cheyney

(57) ABSTRACT

A pocket-sized self-defense spray device is capable of dispensing a chemical irritant to cause temporary breathing difficulty and a burning sensation in the eyes of the target without any permanent damage. The device comprises a casing, a nozzle, and a multi-position trigger. The trigger is slidably mounted in the casing to be moveable from a safe position to an active position. The casing may contain a battery-powered light that is switched on to illuminate the target when the trigger is in the active position. The trigger button in the second position may then be depressed into an engaged position that causes chemical irritant to be discharged from a removable canister with a poppet valve into a nozzle chamber, and out the nozzle exit at a target. The casing includes an ergonomic finger grip that serves to prevent inadvertent discharge at the user, and ease of aiming at the target.

22 Claims, 22 Drawing Sheets

PERSONAL PROTECTION DEVICE

This application claims priority on U.S. Provisional Application Ser. No. 61/204,927 filed on Jan. 13, 2009, the disclosures of which are incorporated herein by reference.

FIELD OF THE INVENTION

The present invention relates generally to personal chemical irritant dispensers, and specifically directed towards personal chemical irritant dispensers which are compact, and must be quick and easy to operate.

SUMMARY OF THE INVENTION

The present invention is meant to be used by the general public for personal protection. The dispenser itself is designed to fit naturally in either hand of the user in the vertical position, with the spout pointing away from the user. In the preferred embodiment, the user closes their fingers around the lower body the dispenser, and their thumb is placed naturally on the trigger button on the rear end of the head. The user then pushes forward on the trigger button to engage the flashlight assembly on the front end of the head and then pushes down on the trigger button to engage the nozzle assembly and spray the chemical irritant.

The present invention provides an ergonomically shaped dispenser that makes it difficult for a user to not properly aim the dispenser. One of the problems with prior designs is that there was a risk that a user could inadvertently discharge the chemical irritant toward the user and not toward the assailant. The present invention with its unique trigger design as well as the configuration of the nozzle area reduces, if not eliminates, that risk.

The present invention has a discharge head and an ergonomic grip. The discharge head has a front portion and a rear portion. The front portion is provided with a nozzle with a circular shield for discharging liquid irritant. Extending from the front portion to the rear portion there is a top surface with an activating means thereon. This activating means permits fluid in the device to be discharged as desired. The location of the activating means on the top surface of the discharge head facilitates the use of a user's thumb to activate the device.

Extending downwardly from the bottom of the discharge head is an ergonomically designed grip for holding the device in a user's hand. The grip is contoured to facilitate holding the grip so that the discharge nozzle is pointed away from the user. To this end, the grip has a pair of recessed portions on a front face of the device so that the user's fingers can go around the grip. The rear of the handle is relatively smooth so that the device sits comfortably in the palm of a user's hand. The smooth portion is a can of chemical irritant positioned in the device.

OBJECTS OF THE INVENTION

It is an object of the invention to provide a self defense spray device.

It is another object of the invention to provide a dispensing device that discharges a chemical which produces disabling effects in an assailant.

It is a further object of the invention to provide a dispensing device which does not cause any permanent harm to an assailant who has been subjected to the device's chemical discharge.

It is another object of the invention to provide a dispensing device which may be stored in a user's pocket.

It is also an object of the invention to provide a device which may form part of a key ring to aid in ease of finding the device.

It is another object of the invention to provide a dispensing device which may prevent inadvertent discharge at the user.

It is also an object of the invention to provide a device which has a readily recognizable grip to alert the user to the proper orientation to aim the device while still in the user's pocket.

It is another object of the invention to provide a dispensing device which may have a light emitting diode to illuminate the assailant and provide a means of properly aiming a discharge.

DETAILED DESCRIPTION OF THE INVENTION

Figure 1:
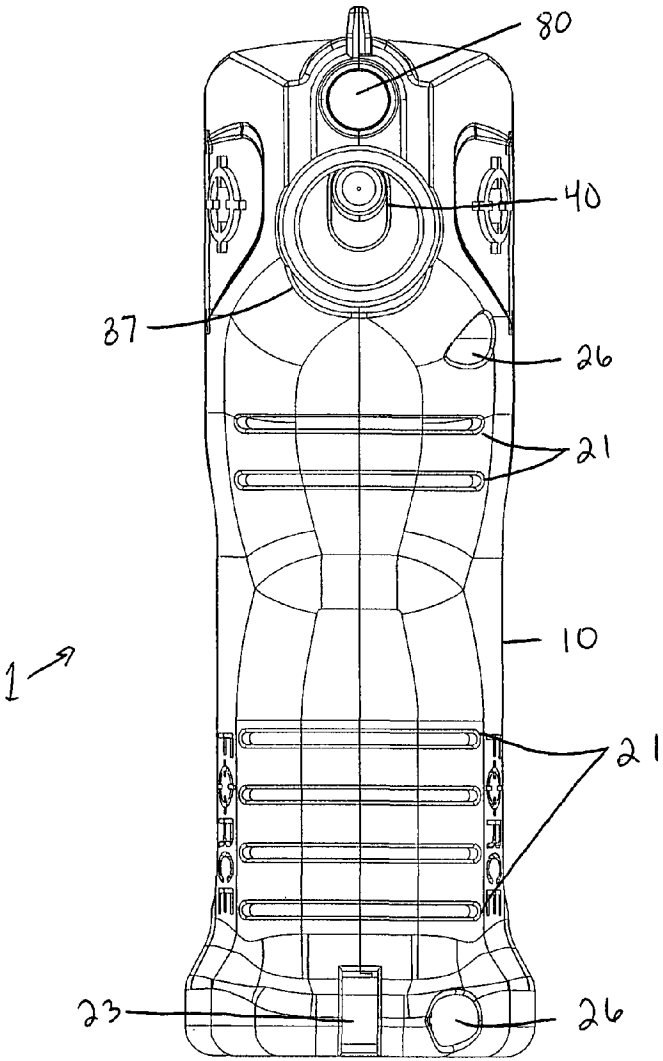
FIG. 1 is a front view of a first embodiment of the chemical irritant dispenser of the present invention.

The overall shape of the pocket pistol or chemical irritant dispenser is cylindrical, which allows it to fit comfortably and naturally in the user's hand. In a first embodiment, the dispenser 1 may principally be comprised of a casing 10, a nozzle assembly 50, a battery-powered light 80, a trigger button 70, and an aerosol canister 90.

Figure 2:
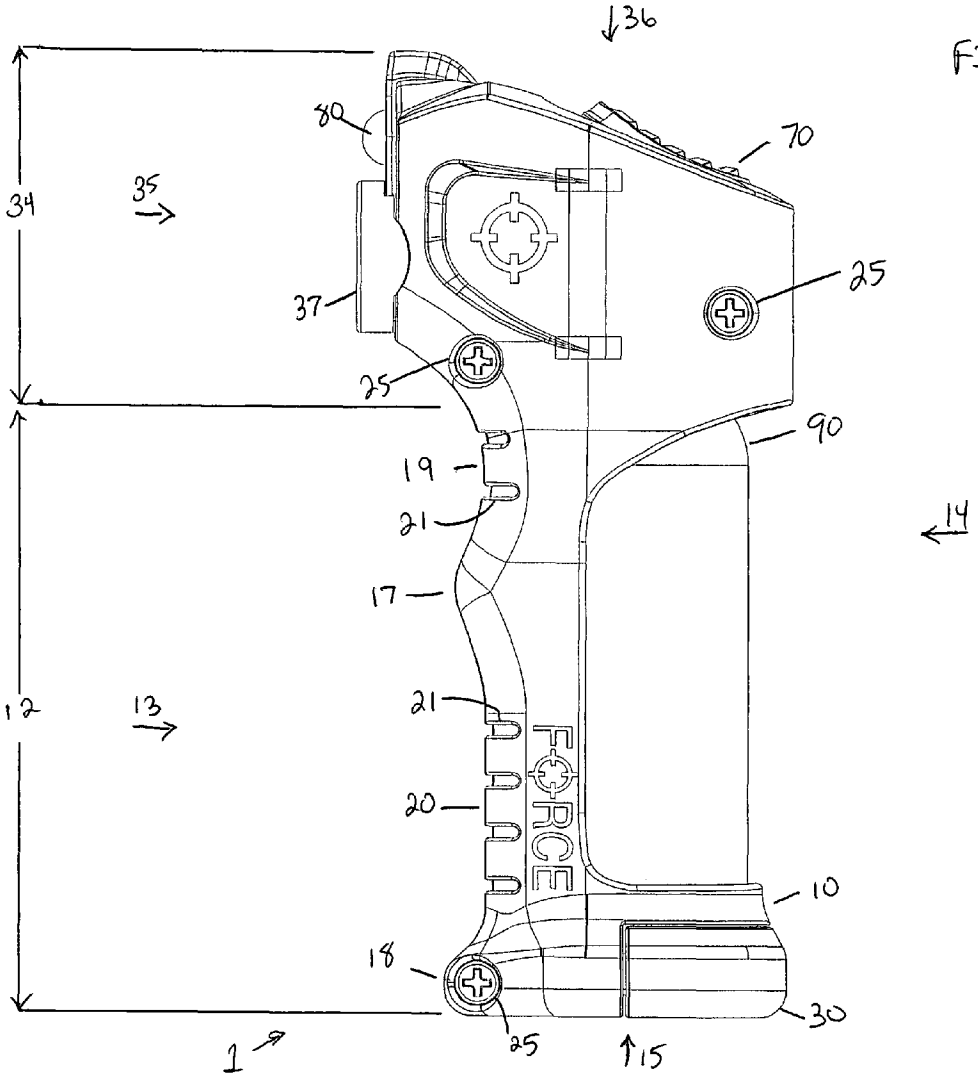
FIG. 2 is a side view of the dispenser of FIG. 1.
Figure 3:
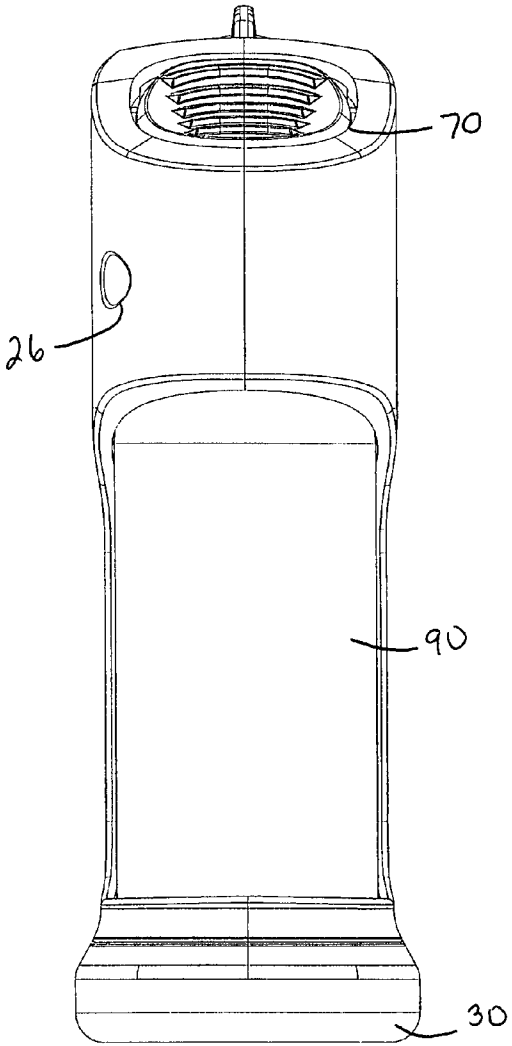
FIG. 3 is a rear view of the dispenser of FIG. 1.

As seen in FIG. 2, the casing 10 may essential be a housing with a cavity and comprise a graspable handle portion 12, and a head portion 34. The casing 10 may be formed in any suitable manner and material, including, but not limited to, molded plastic or a metal casting. Molded plastic may be preferable in order to provide a very light-weight casing 10. The graspable handle portion 12 of casing 10 may form a generally full tubular shape, but the addition of distinctive features about the tubular shape creates a front side 13, a rear side 14, and a base 15. The rear side 14 may have an opening which leaves a portion of the aerosol canister 90 exposed. The opening may serve to reduce the overall effective diameter which the user must grasp, so that the graspable handle portion 12 may fit easily and comfortably within the palm and fingers of most users. Additionally, having a portion of the canister 90 exposed may serve to enable its quick and easy removal from within the casing 10.

The generally tubular shape of casing 10 may also be interrupted on the front side 13 by ergonomic contouring which allows the user to grip the dispenser 1 naturally and securely. The grip may be contoured to facilitate the user holding the graspable handle portion 12 so that the discharge from nozzle assembly 50 is pointed away from the user. The contoured grip allows the user, in the absence of any visual cues, to reach into his or her pocket and quickly acquire a tactile feel as to the proper orientation necessary to hold and properly aim the dispenser 1, and thus may prevent the user from accidentally spraying themselves rather than an assailant. To offer an easily acquired tactile feel, the front side 13 by may have a central peak 17 and a base peak 18 which create two distinct finger gripping regions—an upper finger grip region 19 and a lower finger grip region 20.

The central peak 17 may preferably be located to produce an upper finger grip region 19 that comfortably accommodates the user's pointer finger, while the lower finger grip region 20 comfortably accommodates the user's middle, index and pinky fingers. Other finger gripping arrangements are also possible. Both the upper and lower finger gripping regions 19 and 20 may each have one or more arcuate indentations that run horizontally along the front side 13, and which aide the user in attaining a fast and secure grip. Instead of the arcuate indentations 21, narrow rubber strips (not shown) may also assist in providing a secure and readily recognizable contact surface.

Figure 8B:
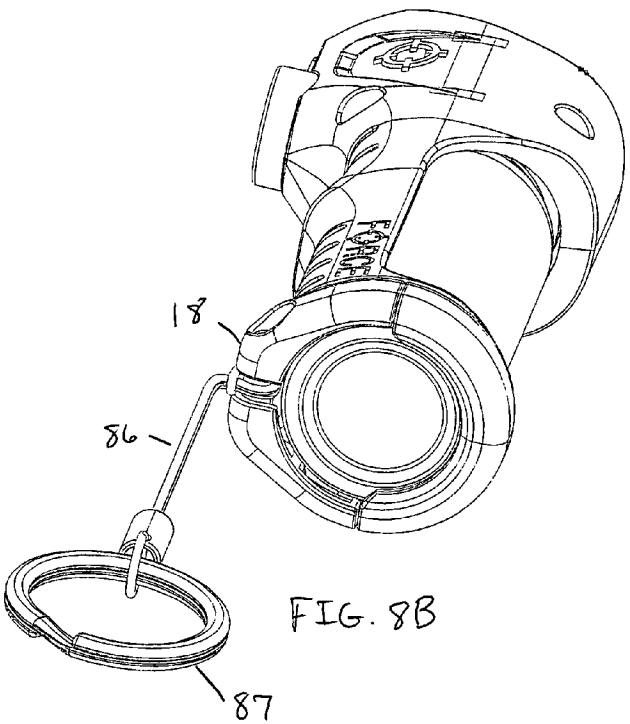
FIG. 8B is a perspective view of the bottom of the graspable portion of the casing, shown with a lanyard attached to a post.
Figure 8:
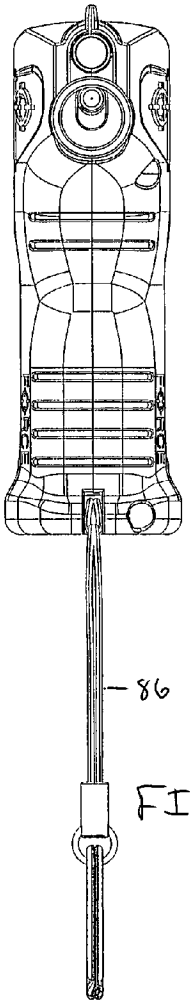
FIG. 8 is a view of the bottom of the graspable portion of the casing, shown with a lanyard attached to a post.
Figure 8A:
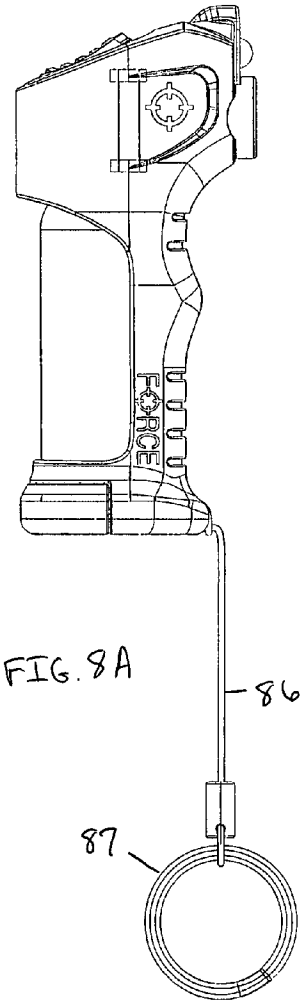
FIG. 8A is a cut-away view of the bottom of the graspable portion of the casing, shown with a lanyard attached to a post.
Figure 9:
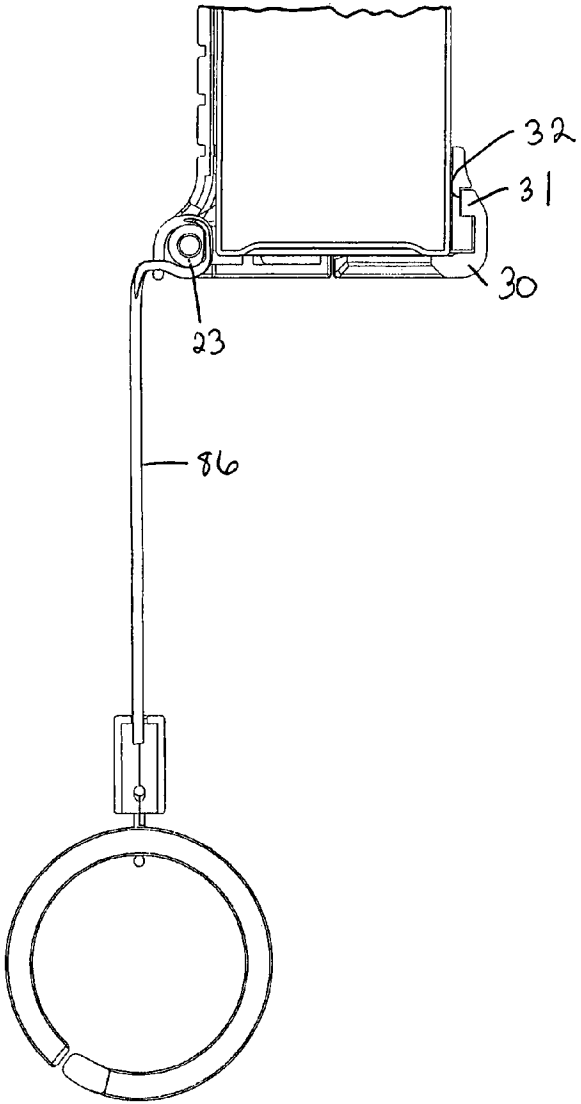
FIG. 9 is a cut-away view of FIG. 8A enlarged to show the latch feature used to retain the canister of chemical irritant within the casing.
Figure 13:
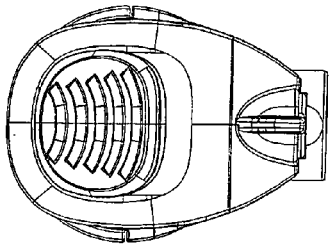
FIGS. 10-14 are a composite arrangement on a single sheet of FIGS. 1-3 and FIGS. 6-7.
Figure 11:
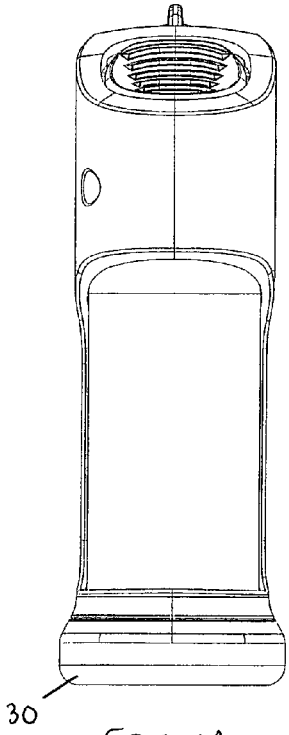
Figure 23:
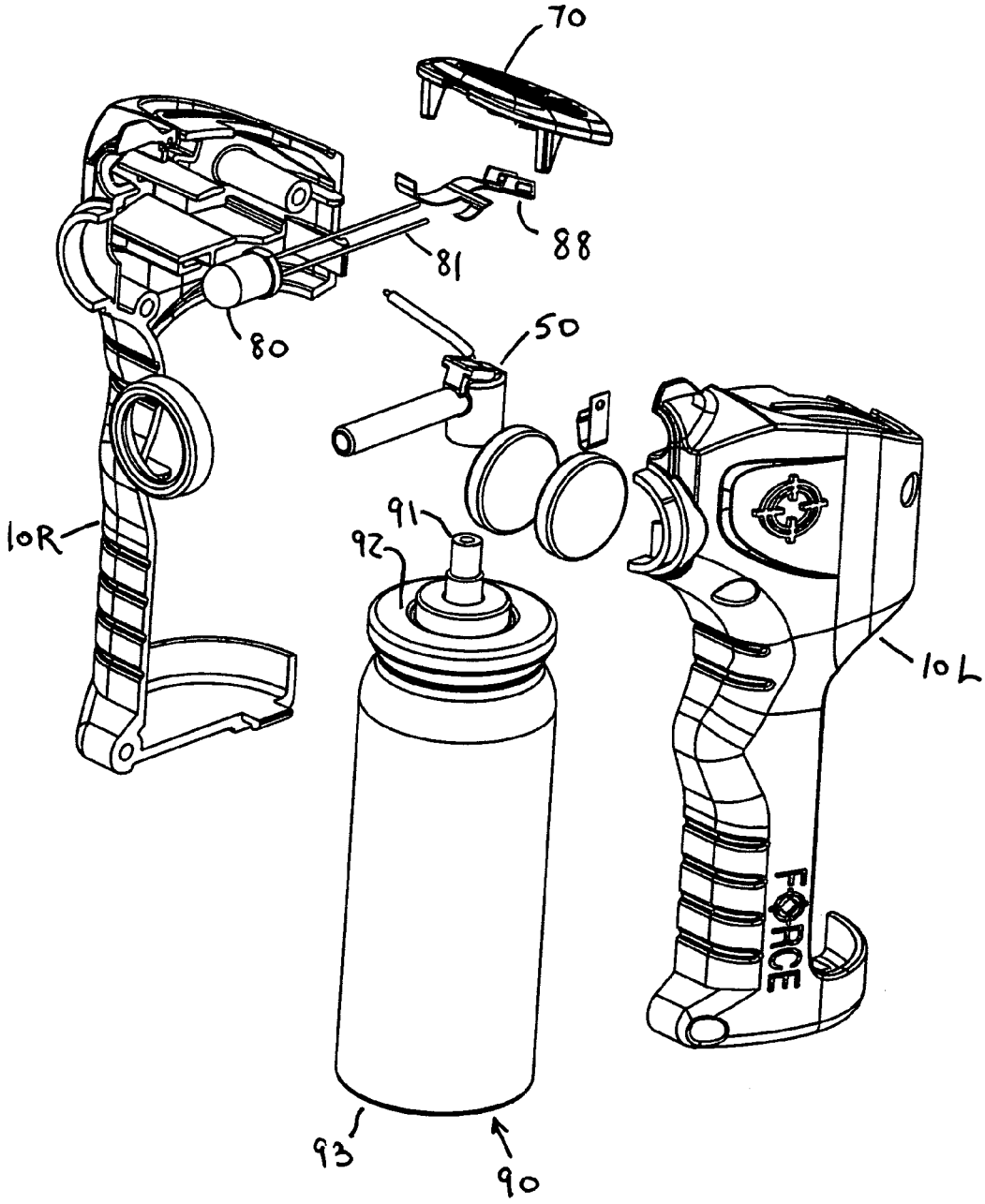
FIG. 23 is an exploded view of some of the parts comprising the dispenser of FIG. 17.

The casing 10 may preferably be manufactured in two pieces (FIG. 23)—a left casing half 10L and a right casing half 10R—to assist in assembling the constituent parts of the dispenser 1 within the casing 10. The left casing half 10L and right casing half 10R may be joined together by a mechanical means, including, but not limited to, screws, or bolts and nuts. In one embodiment, the left casing half 10L and right casing half 10R may each have one or more posts 23 with orifice 24 (FIG. 15), so that when the two parts are assembled together, they may be fastened as shown in FIG. 2 using screws 25. The orifice 24 may preferably pierce the outer surface of only one of the two halves. To give the dispenser a smooth exterior, the left casing half 10L may have orifice 24 pierce the outer surface of the casing half and additionally have a recess or countersink 26 at the surface to permit the screws 25 to be driven inward enough to be inset or at least flush so as to not outwardly protrude an interrupt the dispenser's smooth exterior. The lower screw location may preferably be positioned in the base peak 18. Base peak 18 may also include sculpting or inward relief to expose the outer diameter of post 23 at that location, to permit attachment of a lanyard 86 with a key ring 87 (FIGS. 8-8B).

Figure 10:
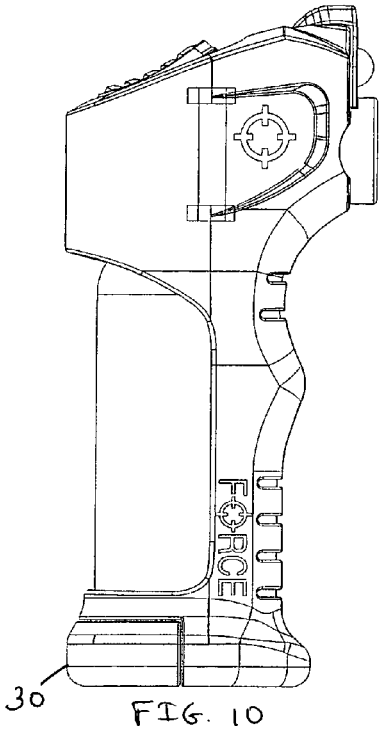
Figure 12:
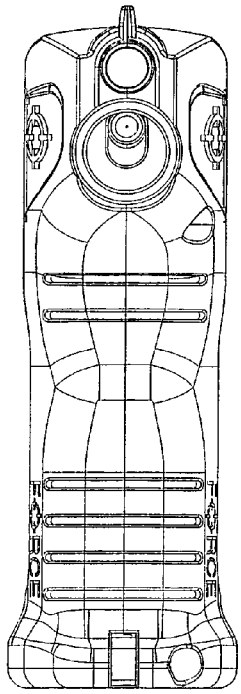
Figure 14:
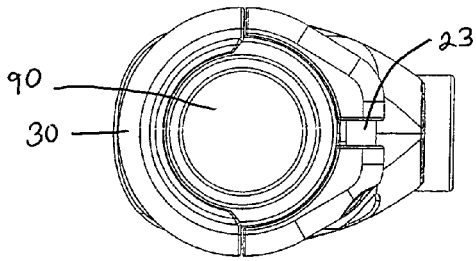

The base 15 of the graspable handle portion 12 of casing 10 may have a circular opening 29, of sufficient size such that canister 90 may be inserted therein. Base 15 may also incorporate a latching cover 30 (FIGS. 10 and 14) that secures the canister within the casing 10 by obstructing at least a portion of circular opening 29. Latching cover 30 may have one or more male protrusions 31 that may be slidably received by, and also snap or clip into, a female indentation 32 in the casing 10. Latching cover 30 may alternatively be pivotally attached (not shown) to the casing 10.

The head portion 34 of the casing 10 may be comprised of a front side 35, and top side 36. The front side 35 of head section 34 may have exposed, from the casing 10, a light 80 which may be a shrouded bulb, or preferably may be a light emitting diode (LED). A light 80 in the form of an LED provides desirable functionality for dispenser 1, as it may be compact in size, because LEDs light up quickly, and they may also be narrowly focused like a pointer. The narrowly focused beam of the LED may be aligned with the exit path of the nozzle assembly 50 to assist the user in accurately aiming the chemical irritant spray.

Light 80 may have wires 81 that connect the light to a power source. The power source may be one or more batteries 82. The light 80 may be illuminated and subsequently shut off through use of a dedicated switch on the housing, or alternatively, the light may be switched on or off through selective motion of the trigger button 70. In one embodiment, the light may be switched on by depressing the trigger, and in another embodiment, the regular sliding movement of the trigger, described hereinafter, may be used to switch the light on and off. Also protruding from the front side 35 may be a cylindrical shield 37 that may serve to prevent errant lateral discharge of chemical irritant from the nozzle assembly 50, which is set back within the casing 10. Although errant discharge is unlikely, and may be due to various small objects within the user's pocket clogging or partially obstructing the nozzle 50, the cylindrical shield 37 in combination with the exit of the nozzle 50 being recessed with the casing 10 additionally serves to reduce the likelihood of such obstructions occurring.

Figure 4:
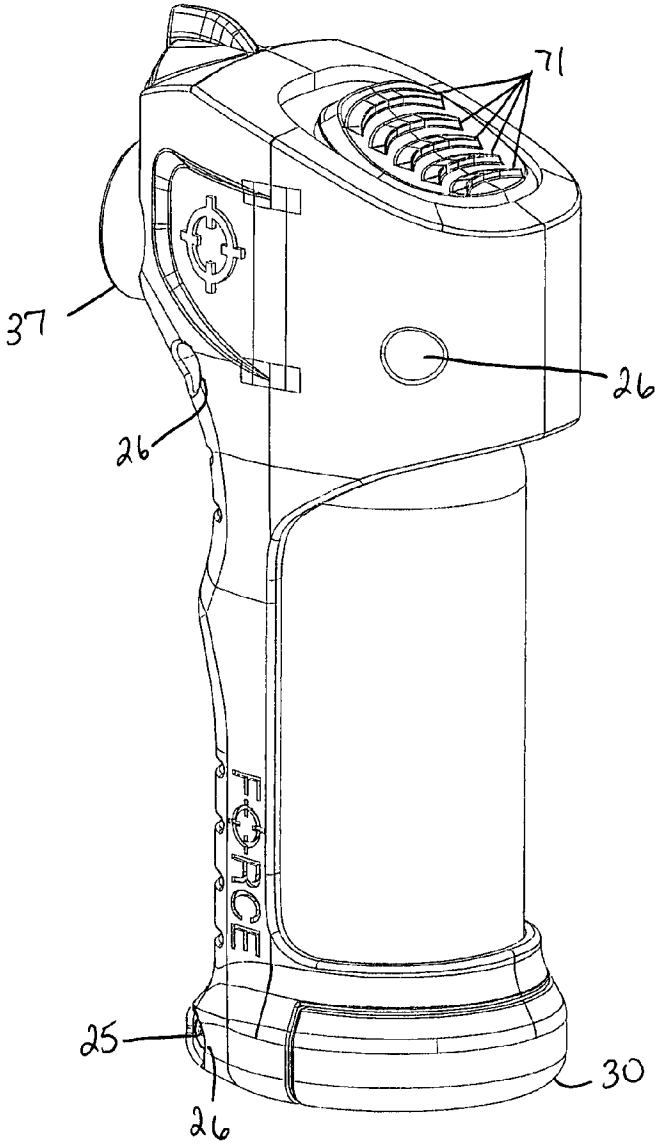
FIG. 4 is a rear perspective view of the dispenser of FIG. 1.
Figure 5:
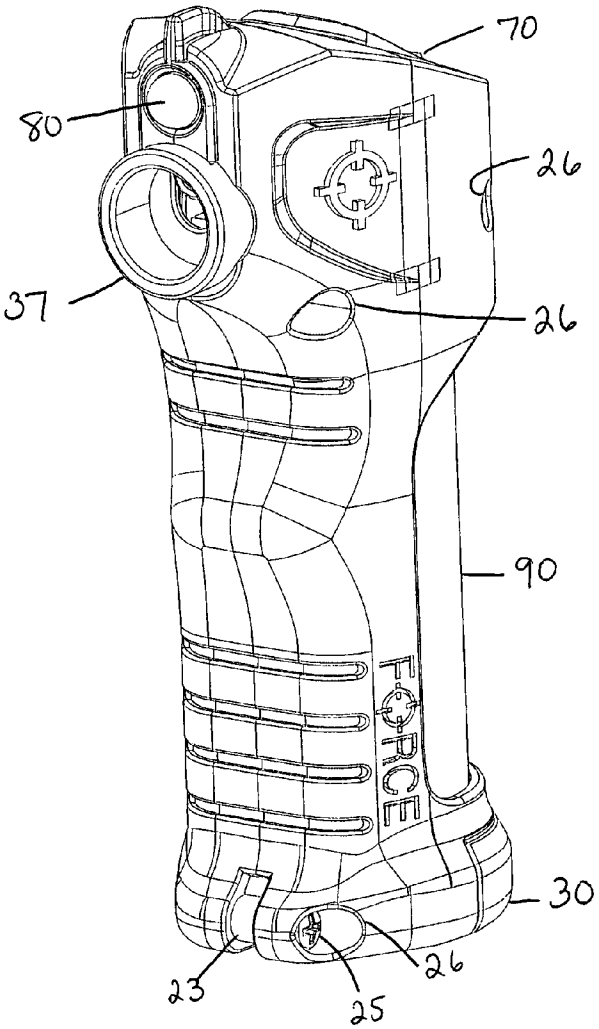
FIG. 5 is a front perspective view of the dispenser of FIG. 1.
Figure 6:
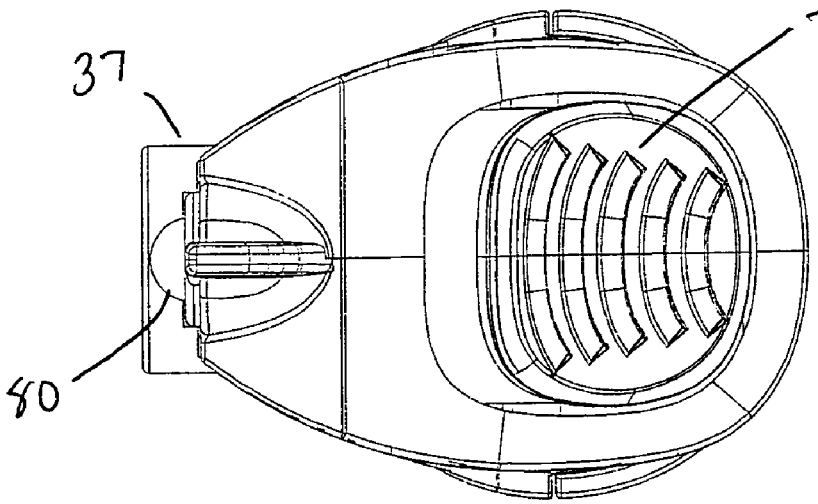
FIG. 6 is a top view of the dispenser of FIG. 1.
Figure 7:
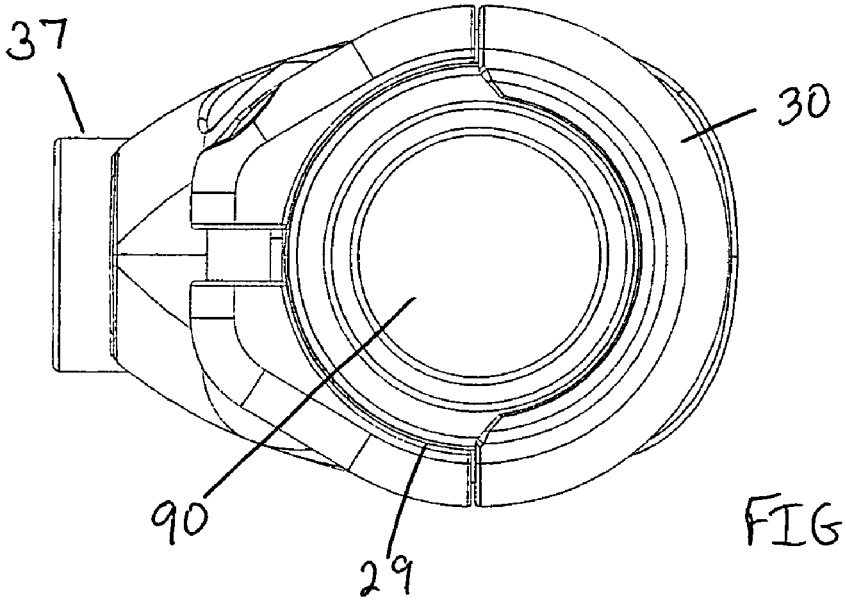
FIG. 7 is a bottom view of the dispenser of FIG. 1.
Figure 21:
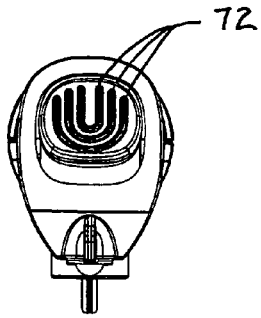
FIG. 21 is a top view of the dispenser of FIG. 17.
Figure 18:
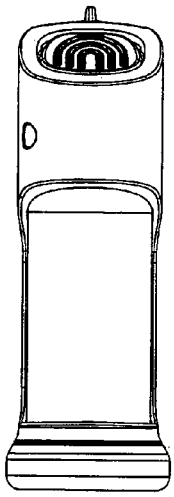
FIG. 18 is a left side view of the dispenser of FIG. 17.
Figure 20:
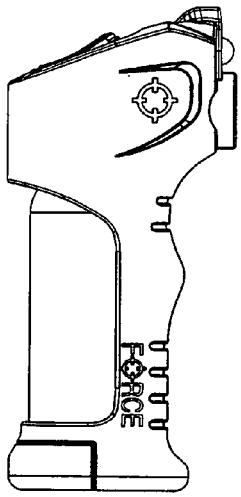
FIG. 20 is a right side view of the dispenser of FIG. 17.
Figure 19:
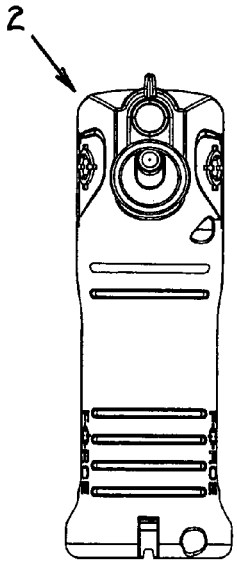
FIG. 19 is a rear view of the dispenser of FIG. 17.
Figure 17:
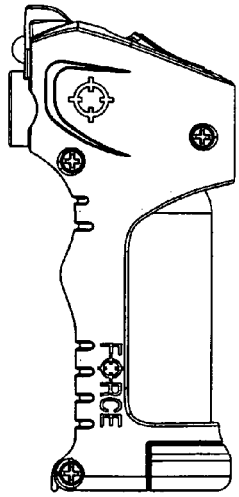
FIG. 17 is a front view of a second embodiment of the chemical irritant dispenser of the present invention.
Figure 22:
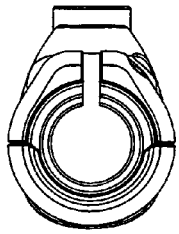
FIG. 22 is a bottom view of the dispenser of FIG. 17.
Figure 29:
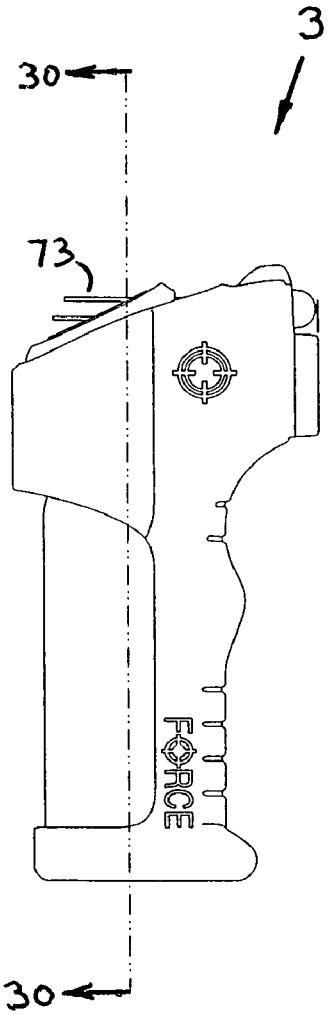
FIG. 29 is a side view of a third embodiment of the chemical irritant dispenser of the present invention.
Figure 30:
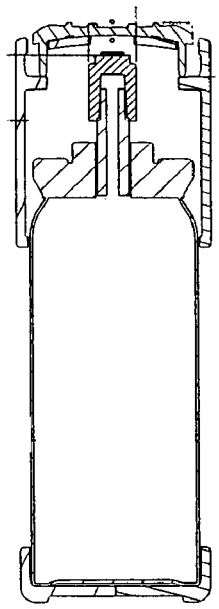
FIG. 30 is a cross-sectional view of the dispenser of FIG. 29.
Figure 33:
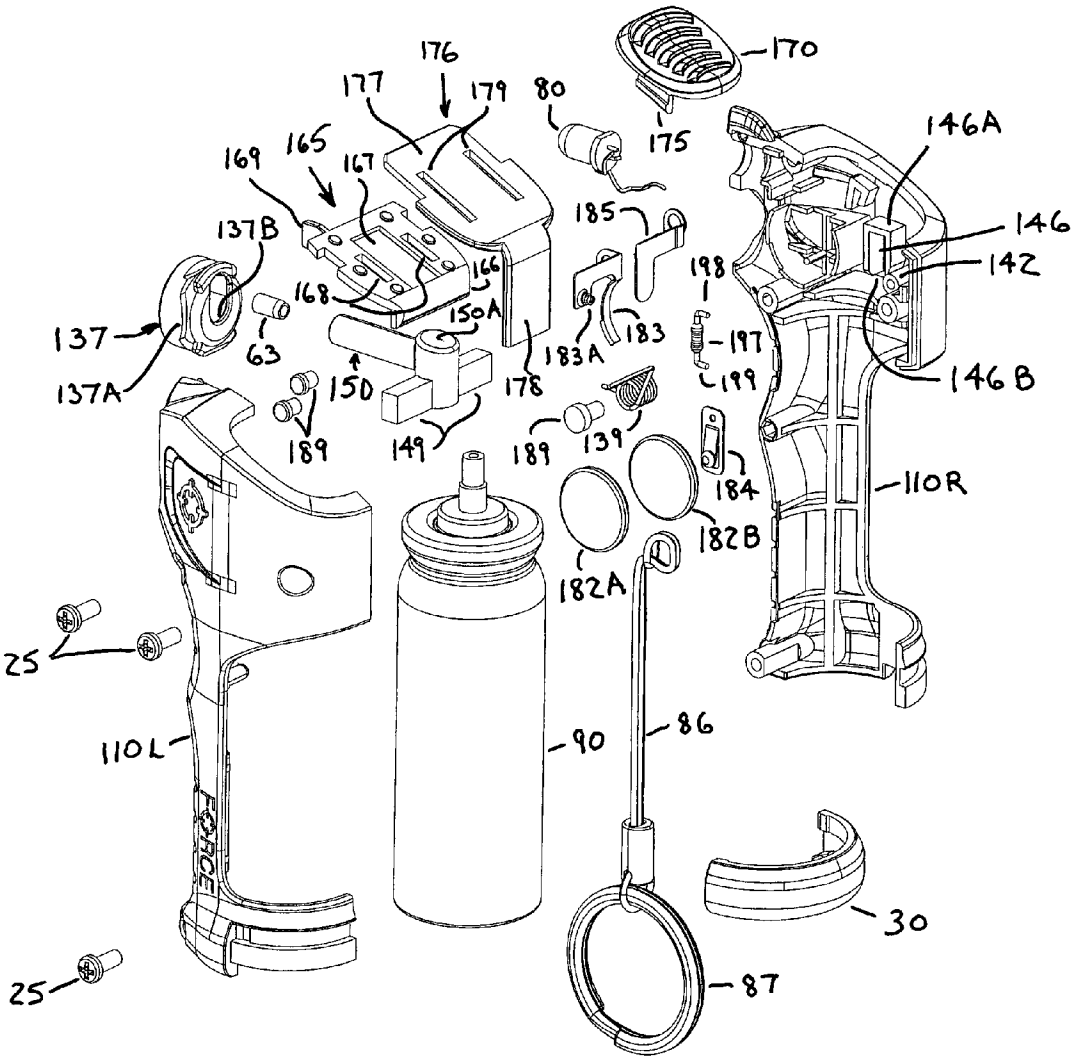
FIG. 33 is an exploded view of a fourth embodiment of the chemical irritant dispenser of the present invention.

The trigger button 70 may be formed and positioned within casing 10 to have a portion protruding out from the top side 36 of dispenser 1, so that it may be contacted and actuated by the user's thumb. To assist the user in gripping the trigger button 70, the exposed surface may have a plurality of raised arcuate protrusions 71 (FIG. 4); or in a second embodiment for dispenser 2, the protrusion may be a partial race-track shape 72 (FIG. 21); or lastly, in a third embodiment for dispenser 3, there may be a plurality of rearward-cantilevered protrusions 73 (FIG. 29).

Figure 24:
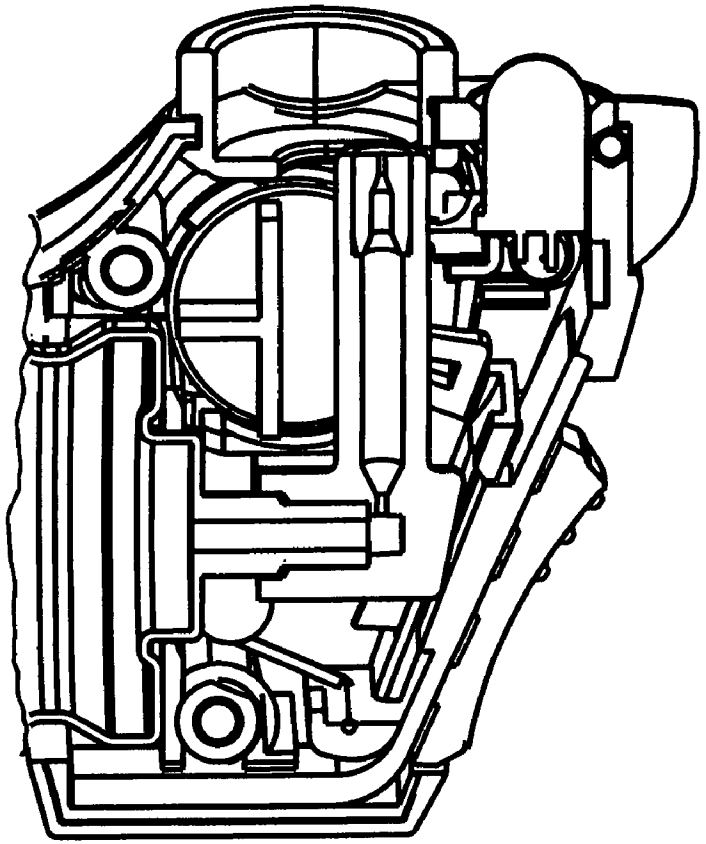
FIG. 24 is vertical cross-sectional view of the dispenser of FIG. 17, taken at the center of the nozzle outlet, with the trigger button in the "safe" position.
Figure 25:
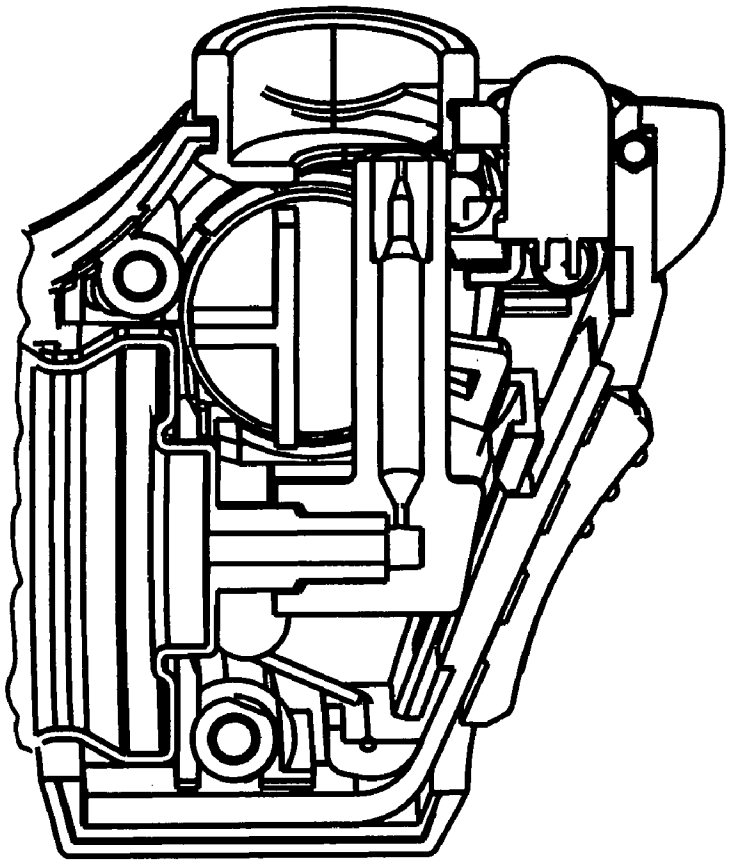
FIG. 25 is vertical cross-sectional view of the dispenser of FIG. 17, taken at the center of the nozzle outlet mid-plane, with the trigger button in the "active" or "ready" position.

The trigger button 70 may be mounted within the dispenser 1 so as to be solely pivotable between each of its discrete positions. However, in a first embodiment, the trigger button 70 may be slidable between a first position (FIG. 24) in which the trigger cannot be actuated to discharge chemical irritant—a safe position—and a second position (FIG. 25)—being an active or ready position. Movement of the trigger button 70, as previously mentioned, may switch on the LED light 80 when the trigger is moved from the first position to the second position.

Trigger button 70 may be biased to normally remain in the first (safe) position using a spring, which may be a helical compression spring, or a torsion spring. This biasing would, among other things, serve to prevent inadvertent movement of the button and accidental discharge while the dispenser 1 is in the user's pocket. Additionally, as a safety precaution to prevent inadvertent movement of the trigger button 70 back to the first position at a time when the user seeks to move the button from the second (ready) position to a third position—an engaged position at which chemical irritant is discharge—the button may be biased away from the first position towards the second position. Biasing of the button toward the second position and away from the first position may occur once the button has been moved a measured amount. Therefore, the button biasing direction may be selective based upon the trigger button's position, such that biasing of the button into the first position may transition to biasing of the trigger button into the second position, once the button has moved at least part of the way toward the second position.

In a preferred embodiment, the selective biasing may be accomplished by a compression spring (not shown) that has one end mounted to a post that is centrally located between the first and second button positions, to thereby have the compression spring be at its smallest effective length (greatest biasing force) when the button is mid-way between the two positions. Such an arrangement would produce position-based biasing as described.

Figure 15:
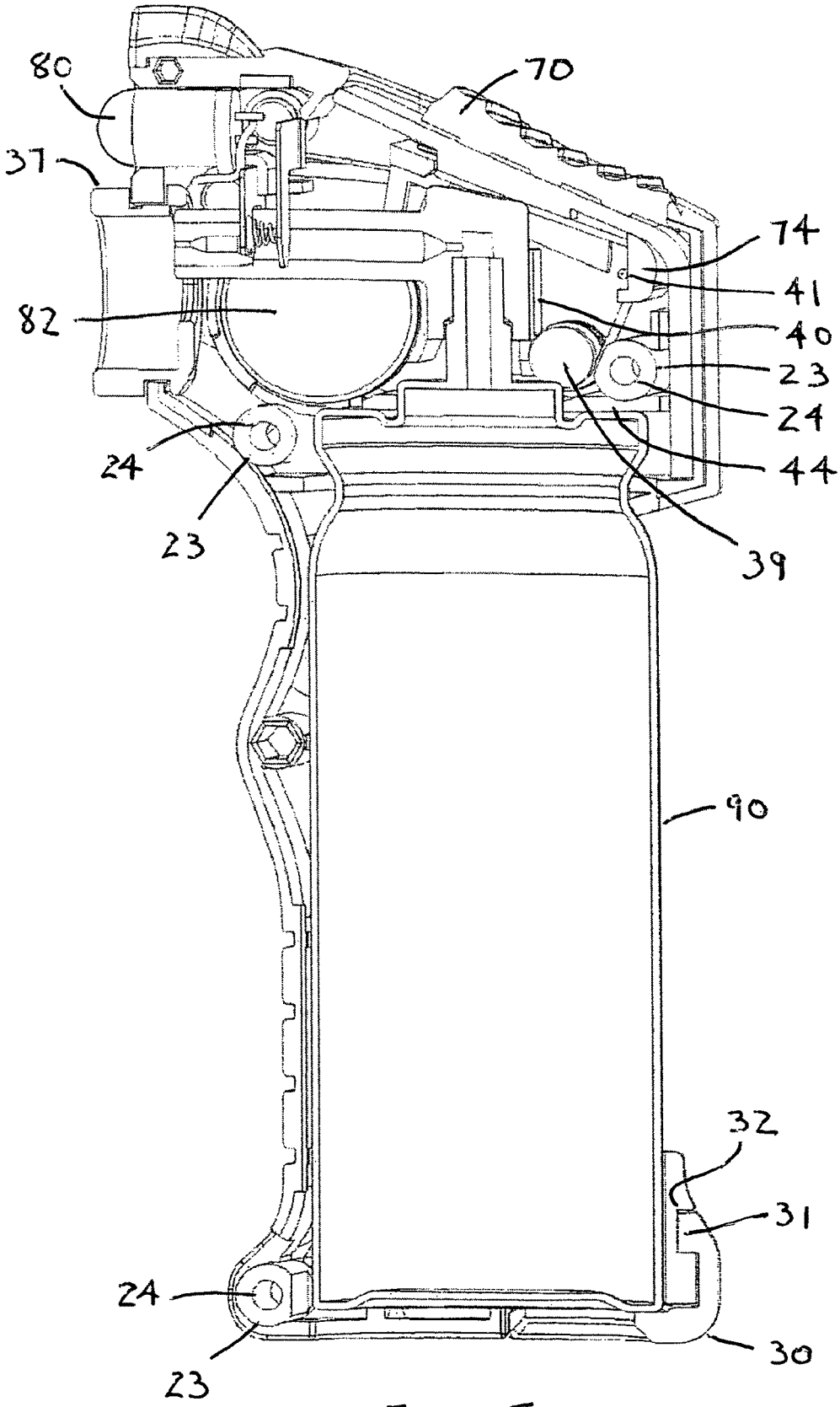
FIG. 15 is a section view of the first embodiment of the chemical irritant dispenser of the present invention.
Figure 16B:
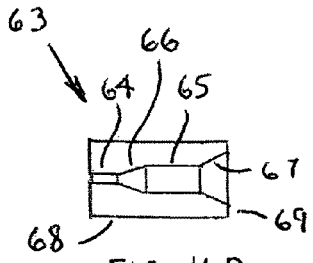
FIG. 16B is a section view of the nozzle flow-adjuster insert.
Figure 16A:
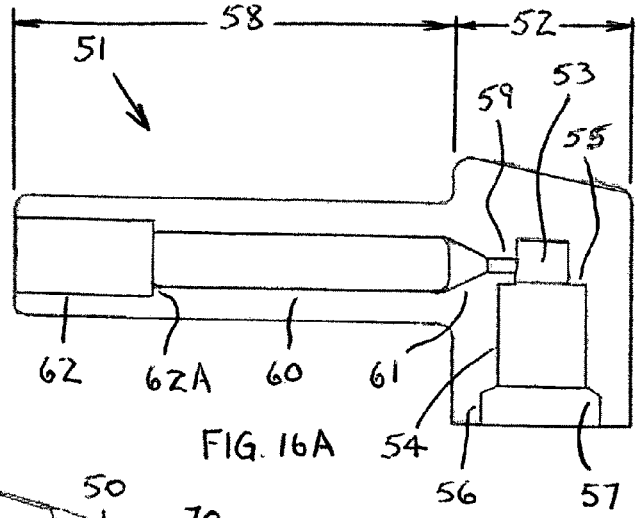
FIG. 16A is a section view of the nozzle housing.
Figure 16:
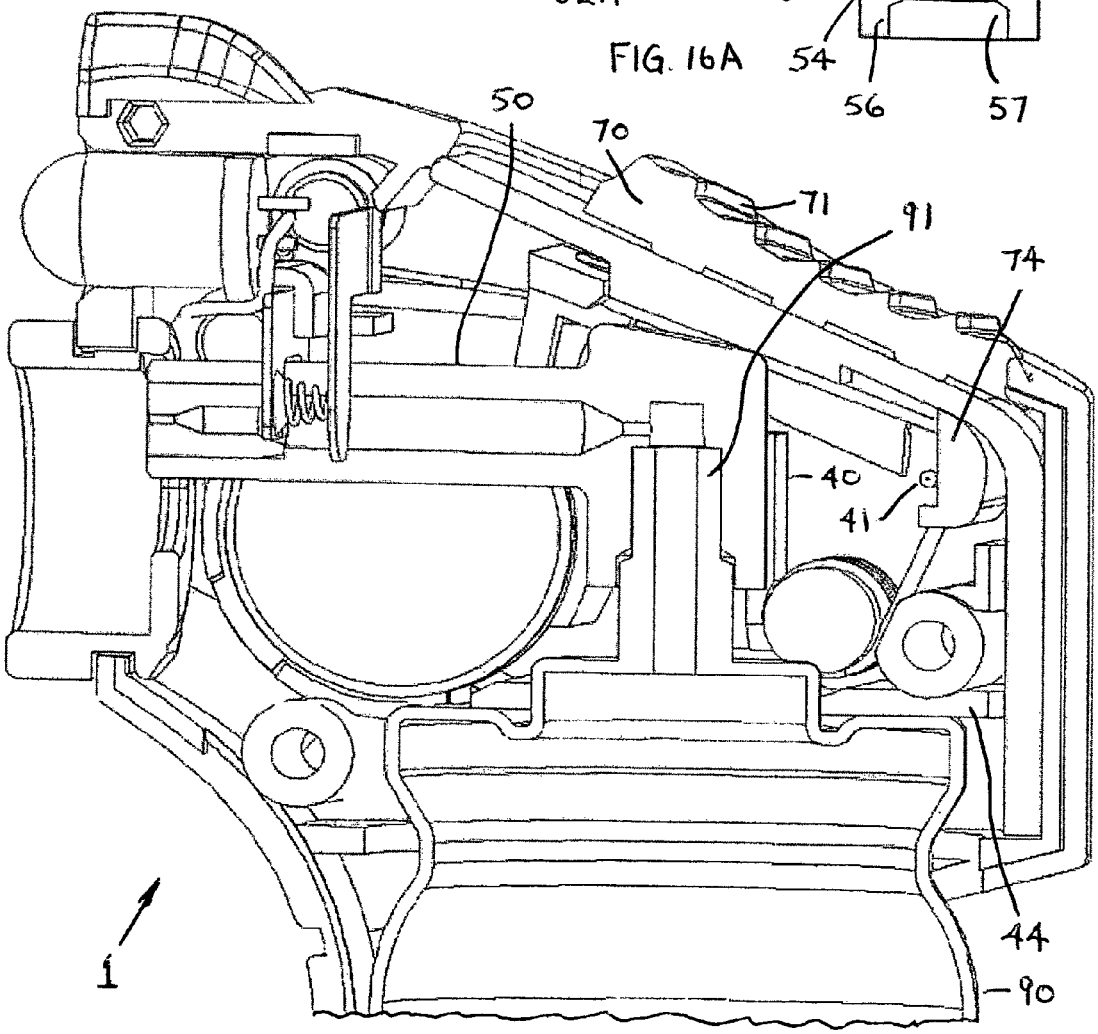
FIG. 16 is an enlarged section view of the head portion of the chemical irritant dispenser of FIG. 15.

In dispenser 1, a torsion spring 39 may have its helical portion mounted to a post 42, with one of its straight ends 40 fixed against a wall of the casing 10 and the other straight end 41 being compressed to pre-load against a downward protruding lip 74 of trigger button 70 (FIGS. 15-16). Since the downward protruding lip 74 of trigger button 70 is shown located to one side of the button, and does not engage the torsion spring at a position central to the first and second button positions, it would not, as shown, provide the position-based biasing previously described. However, to one skilled in the art, it is apparent that the arrangement could be modified so that a torsion spring could also achieve the position-based biasing, and may necessarily depend on positioning of the undeflected straight end 41 of the spring to be at the central location between the first and second positions; on the distance of the trigger's throw in moving between the first and second positions; and on the shape/length of a protruding feature of the button that would be engaged by the spring, which must necessarily be more extensive than downward protruding lip 74.

As stated above, the trigger button 70, when in the second (ready) position with the LED light 80 illuminated and focused on a target, may be moved to the third (engaged) position at which chemical irritant would be discharged at an assailant. This movement of the trigger button 70 to the third position may occur with the user's thumb applying a downward force to the button. It should be noted that the illuminated LED may thus also serve to alert the user that the dispenser's trigger button 70 is active and ready to be depressed.

Movement of the trigger button 70 from the second (ready) position to the third (engaged) position may comprise translational movement or pivotal movement, or a combination of such movements. In a preferred embodiment, the trigger button 70 may pivot from the second position to the third position and engage the nozzle assembly 50. The trigger button 70 may preferably be biased from the third position back to the second position, so that the dispenser 1 ceases to discharge chemical irritant once the user no longer applies the requisite amount of force needed to overcome such biasing, so that a discharge will only occur through the conscious effort of the user. Biasing from the third position back to the second position may be achieved using a biasing means that is independent from that which produces the selective biasing between positions one and two, and may be through a spring means in the form of a torsion spring, a coil spring, or a leaf spring. In a preferred embodiment, leaf spring 88 (FIG. 23) maybe used. Additionally, biasing may be derived from pressure in the canister 90 seeking to restore its poppet valve 91 to a closed position, based on the following interactions.

The requisite depression or rotation of the trigger button 70 into the third position causes engagement with the nozzle assembly 50, which in turn engages the poppet valve 91 of the canister 90. A nozzle is a device that is designed to control the direction and/or characteristics of a fluid flow as it traverses an enclosed chamber or pipe via an orifice, and it typically varies in cross sectional area to achieve such characteristic changes. Nozzle assembly 50 accomplishes both functions. As seen in FIGS. 16-16B, nozzle assembly 50 may comprise a nozzle housing 51, and a flow adjusting nozzle insert 63. While the combined arrangement could be manufactured as a single part, using such an assembly permits easier and cheaper manufacturing, as each part has no internal chamber and conversely has telescoping openings which may be bored from a single direction. The assembly so configured also permits changing of the nozzle insert 63 after assembly of the entire dispenser 1, from the front side 35 of head portion 34.

The nozzle housing 51 may accomplish the direction change by having a vertical housing portion 52 integrally connected to a horizontal housing portion 58. The direction change may be approximately 90 degrees to facilitate ease of discharge by a user, but could also be at other angles to aid a shorter user who may need to cause a discharge at a significantly taller assailant. Vertical housing portion 52 may thus have a first bored opening 53 that is to a depth most of the way into the nozzle housing 51. A second bored opening 54 may be of a greater diameter than bored opening 53, and be to a lesser depth to produce shoulder 55. Lastly, a third bored opening 56 may be of a greater diameter than bored opening 54 and may also be to a lesser depth to produce the telescoped opening in shown in FIG. 16A for the vertical housing portion 52. Bored opening 56 may be made using a cutting tool to produce the angled surface 57.

Similarly, the horizontal housing portion 58 may have a relatively small first bored opening 59 that interconnects with bored opening 53 of the vertical housing portion 52. A second bored opening 60 in the horizontal housing portion 58 may be of a greater diameter than bored opening 59, and to a lesser depth. Bored opening 60 may also be made using a cutting tool to produce the angled surface 61. Lastly, bored opening 62 may be of a greater diameter than bored opening 60, and to a lesser depth to produce shoulder 62A. The order of boring each of the openings for either the horizontal housing portion 58 or the vertical housing portion 52 may, of course, be reversed.

The flow adjusting nozzle insert 63 may have an outer surface 68 that corresponds to the opening 62 in nozzle housing 51, and, in fact, need not be cylindrically shaped, but could be rectangular. However, the simplest shapes to create and assemble would entail having outer surface 68 to be a cylinder having a diameter that is sized to accommodate an interference fit with bored diameter 62, where installation may be done by a press-fit or a cryogenic operation. Flow adjusting nozzle insert 63 may have an exit bore 64 that is sized to produce the desired spray characteristics. A second bored opening 65 may be of a greater diameter and connect to bored opening 64 with a tapered surface 66. Lastly, a countersink or flared opening 67 may enlarge bored opening 65. The flared opening 67 may leave a face 69 of sufficient area to bear upon shoulder 63 of the nozzle housing 51, when nozzle insert 63 is inserted therein to create nozzle assembly 50, as seen in FIG. 16.

Figure 27:
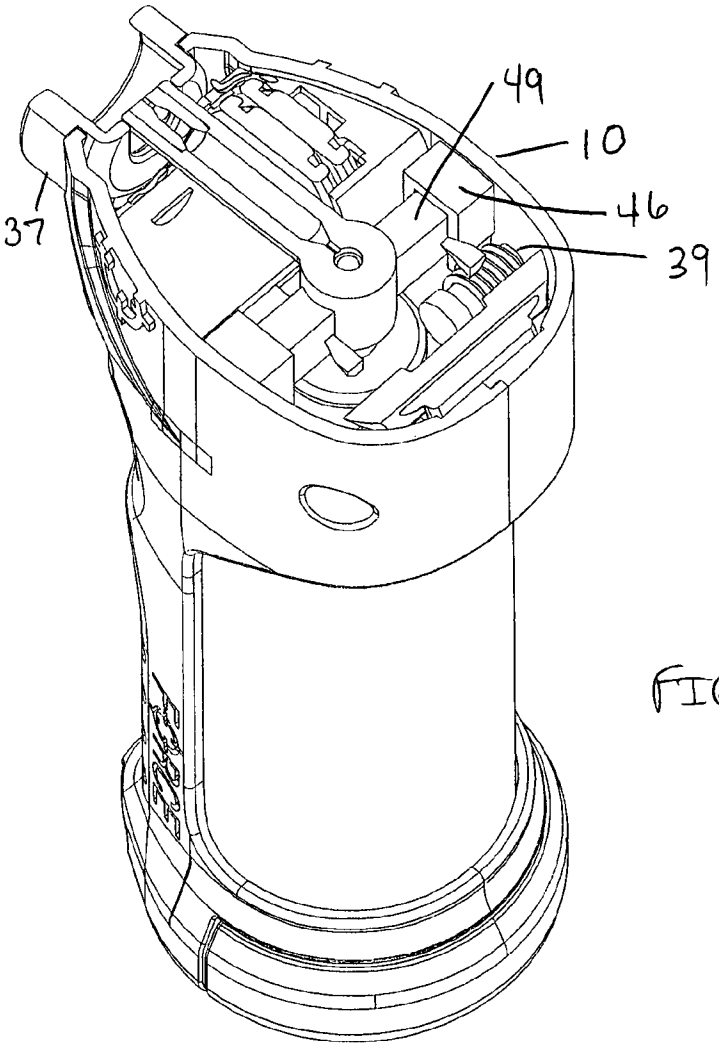
FIG. 27 is a perspective cross-sectional view of the dispenser of FIG. 17, taken horizontally at the center of the nozzle outlet.
Figure 26:
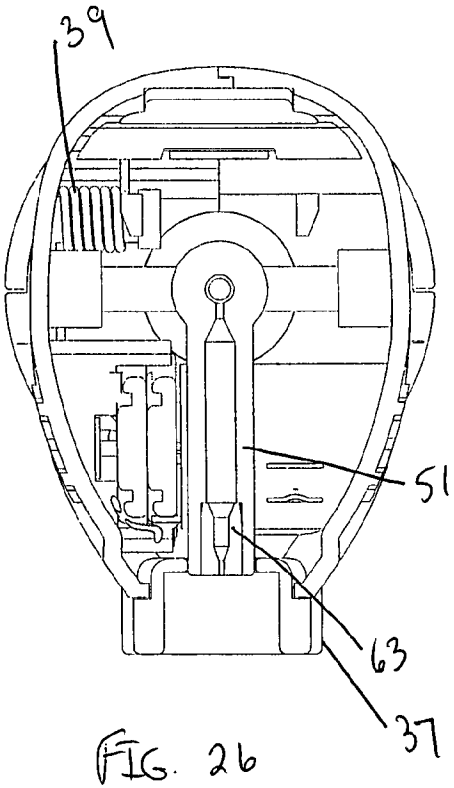
FIG. 26 is a horizontal cross-sectional view of the dispenser of FIG. 17, taken at the center of the nozzle outlet.
Figure 28:
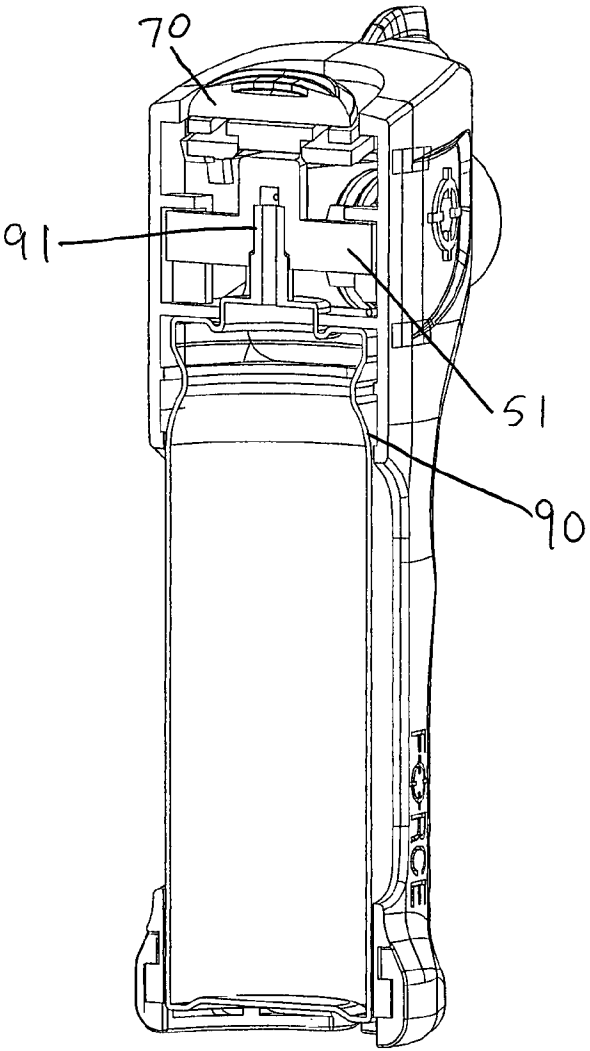
FIG. 28 is vertical cross-sectional view of the dispenser of FIG. 17, taken at the center of the nozzle outlet and oriented orthogonal to the nozzle outlet centerline.
Figure 32:
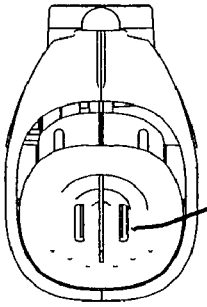
FIG. 32 is a top view of the dispenser of FIG. 29.
Figure 31:
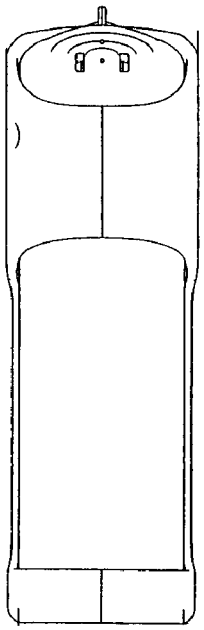
FIG. 31 is a rear view of the dispenser of FIG. 29.
Figure 34:
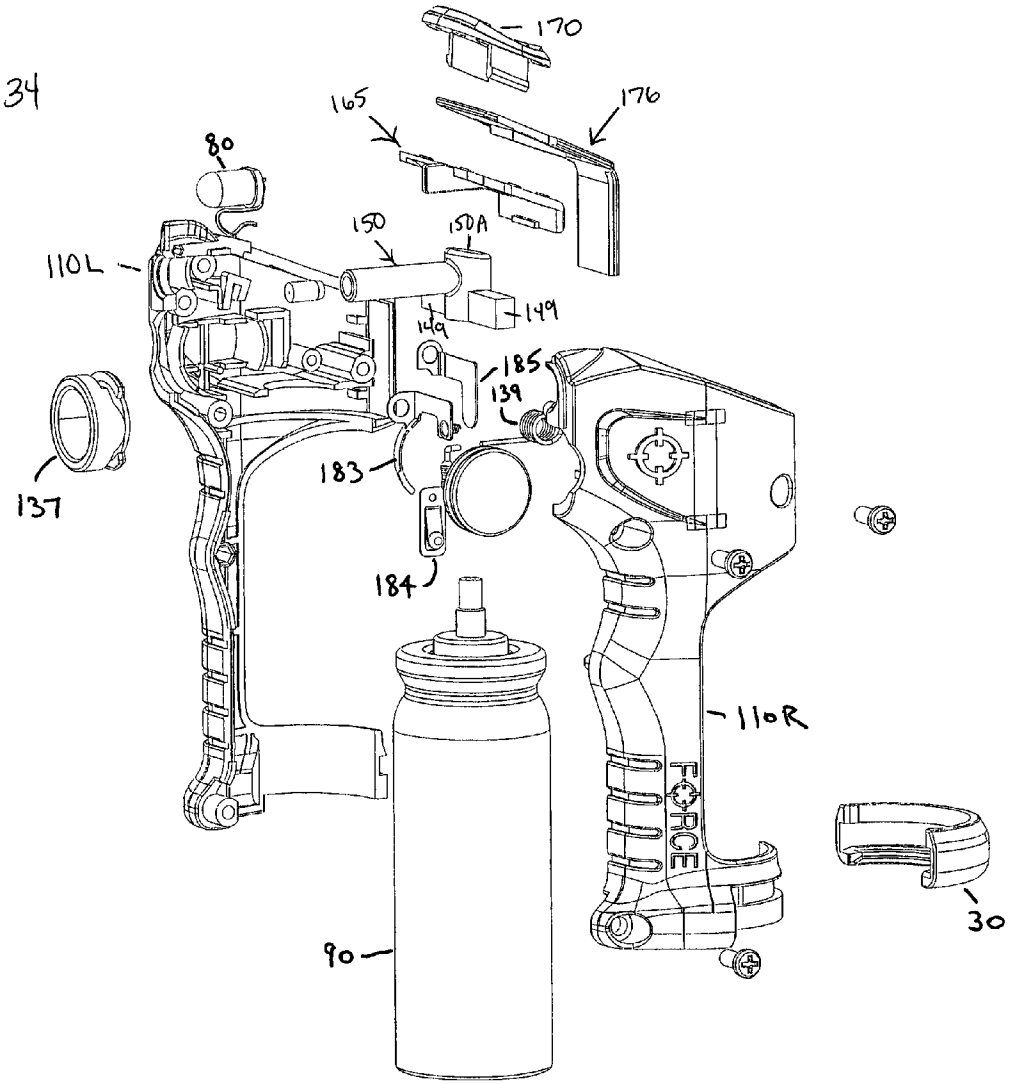
FIG. 34 is an exploded view of the fourth embodiment of the chemical irritant dispenser of the present invention.

The nozzle assembly 50 may be slidably mounted within casing 10 using several different means, including, but not limited to, a cylindrical opening within the casing to receive the vertical housing portion 52. Alternatively, the nozzle housing 51 may have protruding flanges 49 that are slidably received by channel features 46 within casing 10 (FIGS. 27 and 34). The nozzle assembly 50 may be permitted to translate vertically within a range of motion necessary to activate the poppet valve of canister 90, once engaged by the trigger button 70. The nozzle assembly 50 so constructed may receive the spout of poppet valve 91 of the canister 90 within the bored openings of the vertical housing portion 52.

Figure 37:
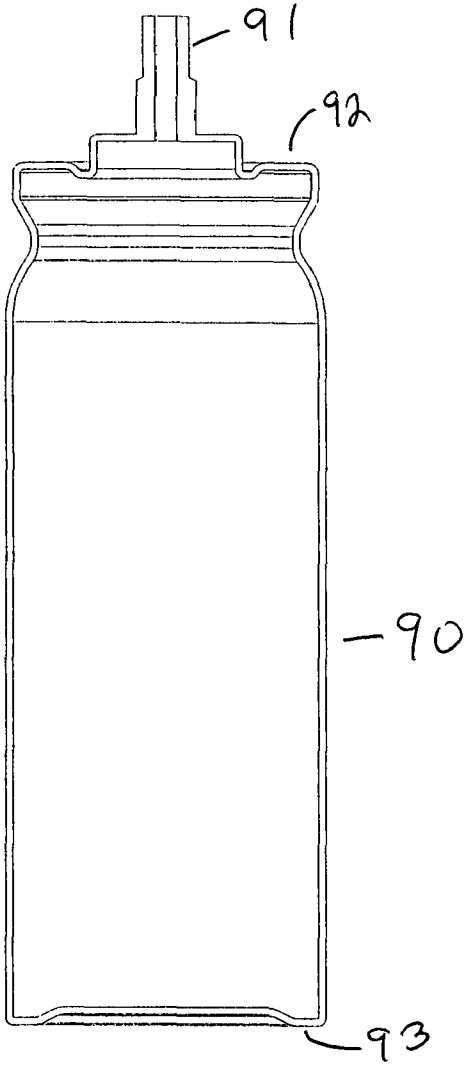
FIG. 37 is a side view of the canister.

Canister 90 may be retained in the bored openings of the vertical housing portion 52 without the poppet valve being engaged by the shoulder 55, by having the canister top surface 92 (FIGS. 23 and 37) bear against a casing wall 44, and being held so positioned by having the latch cover 30 engage the bottom surface 93 of the canister 90. There should therefore be a small amount of vertical play in the nozzle assembly from when the trigger button begins to engage the nozzle assembly, and when the shoulder 55 of the nozzle engages the poppet valve 91 of the canister 90.

Engagement by the shoulder 55 of the nozzle assembly 50, with the poppet valve 91 of the canister 90 causes the release of chemical irritant from the canister. The chemical irritant may then proceed through the bored openings of nozzle assembly 50, resulting in discharge of the irritant out from the nozzle insert 63. The nozzle insert 63 may have the bored opening 64 adjusted in size to deliver a wide and diffuse spray of chemical irritant, or conversely it may be sized and shaped to prove a very narrow discharge spray. The pocket pistol, in a preferred embodiment, may be capable of accurately delivering a discharge that is approximately in the range of 8 feet to 12 feet. The discharge may be accurately delivered when used in combination with the focused LED light 80, and maybe advantageous in a situation where a person has no ability to retreat from an enclosed area and is clearly threatened with imminent harm, but has not yet been physically contacted by the assailant.

The chemical irritant may comprise an aerosol formula, where the aerosol formula is comprised of a liquid concentrate and a propellant. Such propellants are typically a gas. The liquid concentrate may comprise a number of different active ingredients, but in a preferred embodiment, the active ingredient of oleoresin capsicum may be used.

Use of the active ingredient oleoresin capsicum may be advantageous to cause startling and disabling effects upon an assailant, including, but not limited to, a painful burning sensation in the eyes of the target, and difficulty breathing which creates a choking feeling. The active ingredient of oleoresin capsicum is also advantageous in that is only produces temporary effects, and cause no permanent harm.

Figure 35:
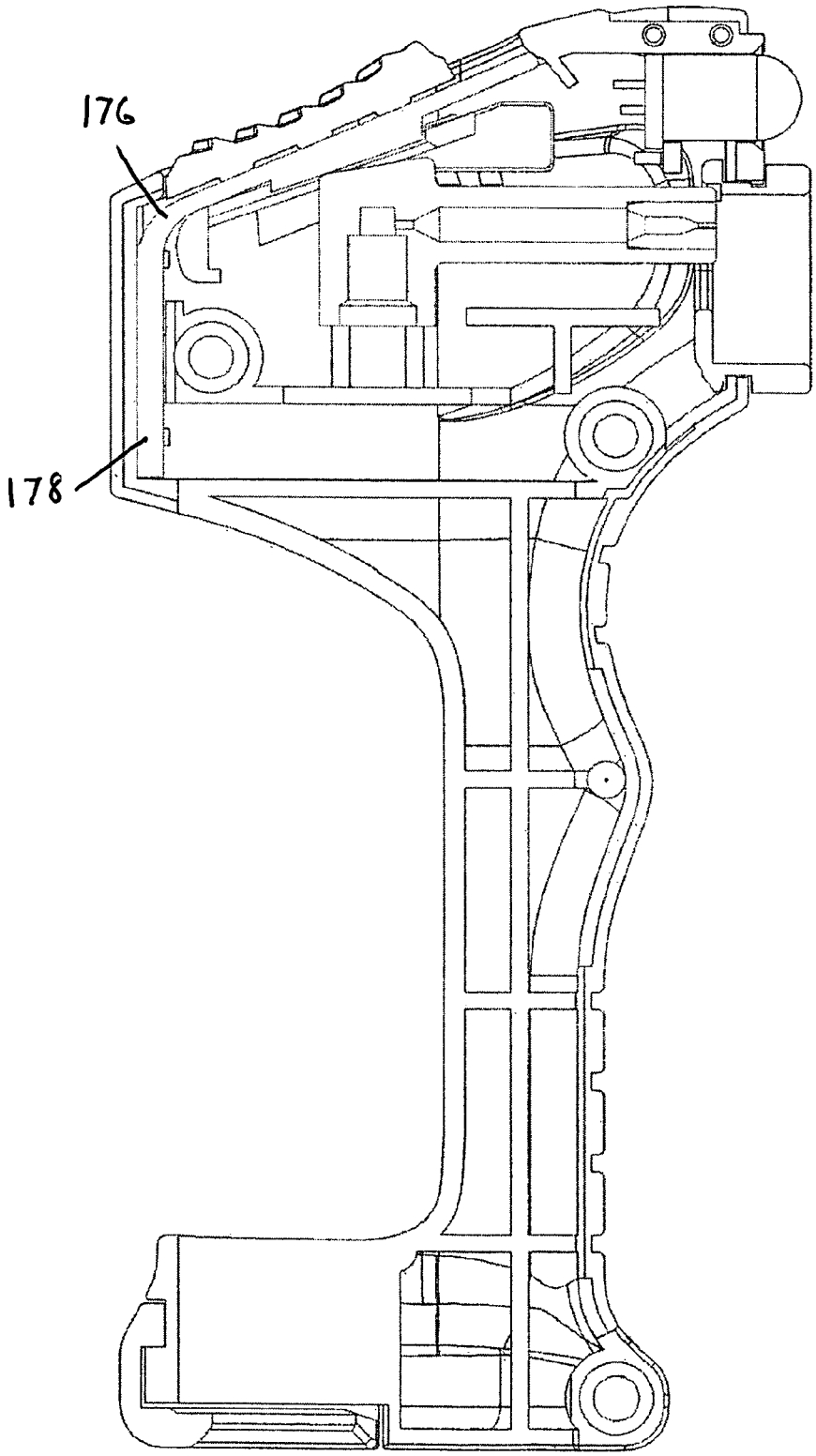
FIG. 35 is a section view of the left side of the fourth embodiment of the chemical irritant dispenser of the present invention, without the canister installed therein.
Figure 36:
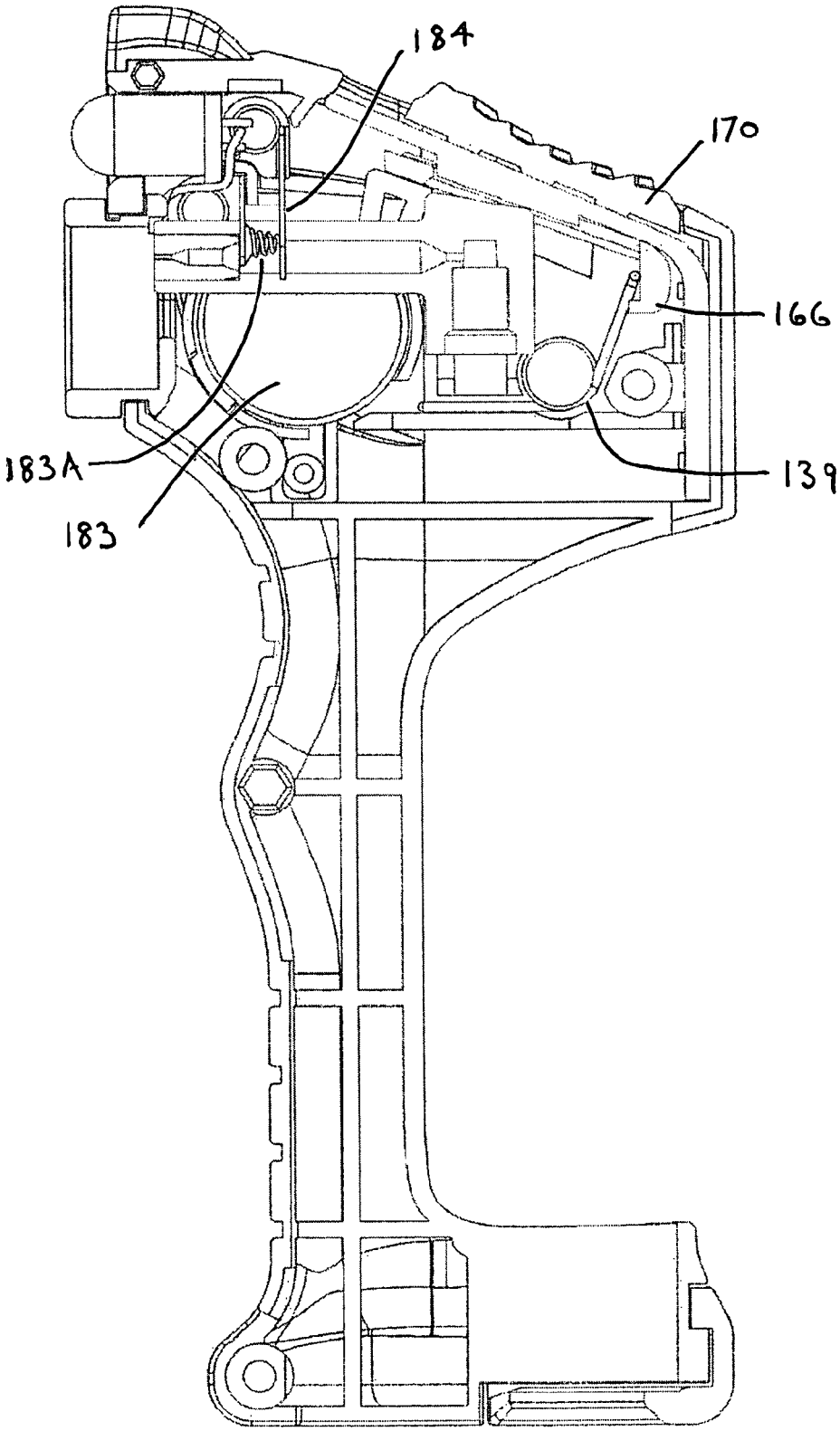
FIG. 36 is a section view of the right side of the fourth embodiment of the chemical irritant dispenser of the present invention, without the canister installed therein.

In a fourth embodiment, FIGS. 34-36, the nozzle assembly 150 may have protruding flanges 149 which may be received in a rectangular opening 146 in each of the two casing halves, 110L and 110R. The top of the rectangular opening 146A and the bottom 146B may serve as stops for the flanges 149 to appropriately limit travel of the nozzle assembly as previously described. The cylindrical shield 137 may be mounted to the casing 110 by trapping a flange 137A therein. Cylindrical shield 137 may have a race-track shaped opening 137B to slidably receive the nozzle assembly 150 and its translational motion. The trigger switch 170 may have mounting protrusions 175 that that may be slidably received in slotted openings 179 of leaf spring 176. The leaf spring 176 may bias the depressed trigger switch 170 to its normal, un-depressed position by having its mounting flange 178 nested within the casing (FIG. 35). When the trigger switch is slid away from the user, it may switch on the light 160. In this embodiment, the trigger switch 170 may be depressed from either sliding position to have its flange 177 contact the top 150A of nozzle assembly 150. An electrical contact 183 may be connected to the cylindrical periphery of disk-shaped battery 182A, and may have a coiled connection means 183A protruding therefrom. A biased electrical contact 184 may contact the flat side portion of disk-shaped battery 182B. A secondary electrical contact 185 may also be included. The electrical contacts may be installed within the casing 110 using pins 189. Torsion spring 139 may also be pinned to the orifice in post 142 using pin 189. The fourth embodiment may incorporate a sliding member 165 beneath the leaf spring 176 that may have a protruding contact flange 169 that may, when the trigger switch 170 is slid forward, force the secondary electrical contact 185 forward to make contact with the coiled connection means 183A and close the circuit to power the LED. The circuit may also include a resistor 197 or other electrical components as necessary. Sliding member 165 may also have a rectangular opening 167 to provide clearance with the nozzle assembly 150 upon its installation. The leaf spring skirt 165 may have a downward protruding flange 166 that may be contacted by the torsion spring 139 to bias the trigger switch 170, which is fixed to leaf spring skirt 165 by having openings 168 receive the trigger mounting protrusions 175.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence; or arrangement or positioning of elements and members of the preferred embodiment without departing from the spirit of this invention.

The invention claimed is:

1. A personal protection device comprising a casing, a nozzle assembly, a light source coupled to a battery, and a trigger member; said casing comprising a head portion and a graspable portion extending from said head portion, said head portion supporting said light, said battery, and said trigger, and a graspable portion supporting said pressurized source of chemical irritant, said graspable portion of said casing further comprising a front side, a rear side, and a base, wherein said rear side has an opening to leave at least a portion of said pressurized source exposed, said opening in said rear side allowing quick removal of said pressurized source from said canister and said opening reducing the overall size of said graspable portion for grasping by a user, said base of said graspable portion comprising an opening that is adapted to allow said pressurized source to be insert into said graspable portion and said base further comprising an adjustable cover secured to said opening of said base wherein said cover obstructs at least a portion of said opening to secure said pressurized source within said graspable portion of said casing, said cover adjustable to allow said pressurized source to be removed from said graspable portion; said trigger member being mounted to said head portion of said casing to be slideable from a first position to a second position; said trigger member switching on said light when moved from said first position into said second position; said trigger member when in said second position being moveable downward from said second position to a third position; said trigger member being biased to move back into said second position from said third position; said movement of said trigger member into said third position causing said nozzle assembly to engage said pressurized source of chemical irritant, said engagement resulting in discharge of said chemical irritant out from said nozzle assembly.

2. The personal protection device of claim 1 wherein said movement of said trigger button between said first position and said second position comprises motion of a type being one or more of: translational movement and pivotal movement.

3. The personal protection device of claim 2 wherein said movement of said trigger button between said second position and said third position comprises motion of a type being one or more of translational movement and pivotal movement.

4. The personal protection device of claim 1 wherein said the exterior surface of said trigger button having at least one of a plurality of arcuate protrusions, a partial race track shape, or a plurality of rearward-cantilevered protrusions for assisting a user in gripping said trigger button.

5. The personal protection device of claim 1 wherein said graspable portion of said casing is tubular.

6. The personal protection device of claim 5 wherein said front side of said graspable portion of said casing further comprises an ergonomic finger grip, said ergonomic finger grip assisting in preventing inadvertent discharge at the user; and wherein said ergonomic finger grip assists in aiming said discharge at a target.

7. The personal protection device of claim 6 wherein said ergonomic finger grip comprises contouring for finger separation.

8. The personal protection device of claim 7 wherein said casing comprises a cylindrical shield, said cylindrical shield preventing errant lateral discharge of said chemical irritant.

9. The personal protection device of claim 8 wherein said pressurized source comprises a canister with a poppet valve; said canister being received by said tubular casing such that pivotal movement of said trigger button to said third position activates said poppet valve to cause discharge of chemical irritant into said nozzle assembly.

10. The personal protection device of claim 9 wherein said chemical comprises an aerosol formula, said aerosol formula comprising a liquid concentrate and a propellant.

11. The personal protection device of claim 10 wherein said propellant is a gas, and said liquid concentrate comprises a active ingredient, said active ingredient comprising oleoresin capsicum.

12. The personal protection device of claim 11 wherein said chemical irritant causes temporary effects comprising one or more of the following: burning sensation in eyes of said target, pain, and difficulty breathing.

13. The personal protection device of claim 12 wherein said nozzle assembly deflects said outward discharge of chemical irritant to be an angle to said discharge from said canister poppet valve.

14. The personal protection device of claim 13 wherein said deflection angle is approximately 90 degrees.

15. The personal protection device of claim 14 wherein said adjustable cover of said base of said graspable portion of said casing is a latching cover for removably retaining said canister.

16. The personal protection device of claim 15 wherein said casing in formed with a first part and a second part, said first and second part being adapted to receive fasteners to connect said first part to said second part, and wherein said fasteners are from the group consisting of screws, or nuts and bolts.

17. The personal protection device of claim 16 wherein said biasing of said trigger button between said first position and said second position is by a spring, said spring being from the group consisting of a torsion spring; and a coil spring.

18. The personal protection device of claim 17 wherein said pivotal biasing of said trigger button from said third position into said second position is by a spring, said spring being from the group consisting of a leaf spring; a torsion spring; and a coil spring.

19. The personal protection device of claim 18 wherein said light is an LED, said LED projecting a focused light beam that is calibrated for alignment with said discharge from said nozzle to assist in aiming said discharge.

20. The personal protection device of claim 19 wherein said discharge from said nozzle assembly is capable of being accurately projected in the range of approximately 8 feet to 12 feet.

21. The personal protection device of claim 20 wherein said casing comprises a post to accommodate attachment of a lanyard with a key-ring.

22. A personal protection device comprising a casing, a nozzle assembly, a light source coupled to a battery, and a trigger member; said casing comprising a head portion and a graspable portion extending from said head portion, said head portion supporting said light, said battery, and said trigger, and said graspable portion supporting a pressurized source of chemical irritant, said graspable portion of said casing further comprising a front side, a rear side, and a base, wherein said rear side has an opening to leave at least a portion of said pressurized source exposed, said opening in said rear side allowing quick removal of said pressurized source from said canister and said opening reducing the overall size of said graspable portion for grasping by a user, said base of said graspable portion comprising an opening that is adapted to allow said pressurized source to be insert into said graspable portion and said base further comprising an adjustable cover secured to said opening of said base wherein said cover obstructs at least a portion of said opening to secure said pressurized source within said graspable portion of said casing, said cover adjustable to allow said pressurized source to be removed from said graspable portion; said trigger member being mounted to said head portion of said casing to be moveable from a first position to a second position; said trigger member switching on said light when moved from said first position into said second position; said trigger member when in said second position being moveable from said second position to a third position, said trigger member being biased to move back into said second position from said third position, and the exterior surface of said trigger member having at least one of a plurality of arcuate protrusions, a partial race track shape, or a plurality of rearward-cantilevered protrusions for assisting a user in manipulating said trigger member; said movement of said trigger member into said third position causing said nozzle assembly to engage said pressurized source of chemical irritant, said engagement resulting in discharge of said chemical irritant out from said nozzle assembly, said nozzle assembly deflecting said outward discharge of said chemical irritant to be at an angle to said discharge from said pressurized source, said nozzle assembly comprising a nozzle housing, wherein said nozzle housing has a vertical housing portion that engages a valve on said pressurized source and a horizontal housing portion that extends from said vertical housing portion, said vertical housing portion comprising a first vertical housing member, a second vertical housing member, and a third vertical housing member, wherein said first vertical housing member is telescopically secured to said second vertical housing member and said second vertical housing member is telescopically secured to said third vertical housing member, said valve being retained in said vertical housing portion and said valve being engaged by said vertical housing portion when said trigger member is moved to said third position, said horizontal housing portion having a first bored opening that connects with a bored opening in said first vertical housing member, and said nozzle assembly further comprising a flow adjusting nozzle insert that has a flared opening that connects to a second bored opening of said horizontal housing portion that is opposite said first bored opening, said flow adjusting nozzle insert further comprising an exit bore opposite said flared opening that controls the nature of the outward discharge of said chemical irritant.

* * * * *